US005395087A

United States Patent [19]

VanBasten

[11] Patent Number: 5,395,087

[45] Date of Patent: Mar. 7, 1995

[54] ADJUSTABLE STAND FOR POSITIVE PRESSURE BLOWER

[75] Inventor: Win VanBasten, Willow Grove, Pa.

[73] Assignee: Dexter Coffman, Fresno, Calif.

[21] Appl. No.: 69,543

[22] Filed: Jun. 1, 1993

[51] Int. Cl.[6] ..... A62C 39/00

[52] U.S. Cl. ..... 248/397; 169/52; 169/91; 248/398; 248/676; 416/63

[58] Field of Search ..... 248/676, 371, 397, 398; 169/52, 91; 416/63

[56] References Cited

U.S. PATENT DOCUMENTS

| | | | |
|---|---|---|---|
| D. 181,083 | 9/1957 | Wells . | |
| D. 181,416 | 11/1957 | Hewitt . | |
| D. 192,622 | 4/1962 | Allen, Jr. . | |
| D. 327,947 | 7/1992 | Clark . | |
| 1,972,654 | 9/1934 | Heath | 416/63 X |
| 2,838,097 | 6/1958 | Gleifsman et al. | 108/9 X |
| 2,850,081 | 9/1958 | Dillon | 248/397 |
| 2,912,046 | 11/1959 | Fuerst | 248/397 |
| 2,954,198 | 7/1958 | Lindberg et al. . | |
| 4,239,459 | 12/1980 | Felter . | |
| 4,261,255 | 4/1981 | Anderson et al. . | |
| 4,657,478 | 4/1987 | LaZebnik et al. . | |
| 4,732,539 | 3/1988 | Shin-Chin . | |
| 4,906,164 | 3/1990 | Jackman et al. . | |
| 5,062,487 | 11/1991 | Siria et al. | 169/91 |
| 5,205,711 | 4/1993 | Raczkowski | 416/63 |

*Primary Examiner*—Alvin C. Chin-shue
*Assistant Examiner*—Derek J. Berger
*Attorney, Agent, or Firm*—Mark D. Miller

[57] ABSTRACT

An quickly and easily adjustable support stand for a positive pressure blower having a stationary assembly attached to a pivotally mounted blower support assembly. A foot plate is attached to a horizontal latching bar having mounting pins at either end thereof. The latching bar is pivotally mounted to the stationary frame, and is held against the back of the larger blower support frame assembly which assembly is also separately pivotally mounted to the stationary frame. By applying pressure to the foot plate (i.e. by stepping on it) the latching bar may be moved away from the pivoting blower support assembly so that its angle of tilt may be adjusted by hand up or down. When the desired angle of tilt is reached, foot pressure to the horizontal bar may be released, latching the blower support frame assembly firmly in place on the stationary frame. This simple adjustment may be quickly accomplished by a fire fighter without even bending over.

17 Claims, 3 Drawing Sheets

ADJUSTABLE STAND FOR POSITIVE PRESSURE BLOWER

BACKGROUND OF THE INVENTION

1. Field of the Invention

The present invention relates to fire fighting equipment, and in particular to a new and improved adjustable support stand for a positive pressure blower device.

2. Description of the Prior Art

Modern techniques of fighting structural fires often involve the use of a positive pressure blower (fan) in order to remove smoke and provide ventilation inside burning buildings. U.S. Pat. No. 4,906,164 to Jackman, et al discloses such a blower. The importance of using such blowers is the quick evacuation of smoke from the building which decreases the potential for smoke damage, and improves visibility and breathing for fire fighters so that they may more efficiently and safely fight the fire.

Because of the unique circumstances in which positive pressure blowers are used, they require several critical features not found in ordinary house fans. In most cases, the blower operates most efficiently when it is set up several feet in front of an open door or window of a burning building. It is important that the funnel of moving air produced by the blower cover the entire opening so that smoke cannot escape back through that same opening (see FIG. 1A). In order to accomplish this, the blower is usually tilted slightly upward, depending on the size and location of the opening in the building.

A pressure blower must also be extremely easy to put into immediate and reliable operation. Thus, is must have wheels for transport, as well as legs for stability once its location is determined. Then, it must be quickly and easily adjustable so that it may be pointed at the opening of the building at the proper angle.

Finally, the blower must be strong, lightweight, and designed to fit into a certain sized compartment on the fire fighting vehicle. It must therefore be operable using gasoline, batteries, or some other portable power source. However, none of these features (size, motor location, or support frame construction) should detract any more than necessary from the overall function of the blower which is to deliver the maximum volume of air possible.

The blower disclosed in U.S. Pat. No. 4,906,164 suffers from two important drawbacks referred to above. First, the large and bulky motor tends to interrupt the free flow of air affecting overall performance. Secondly, adjustment of the support frame is extremely cumbersome and time consuming since it involves a crank mounted to a screw which is manually turned to adjust inclination. Thus, at a time when seconds may be critical, a fire fighter must bend down, grasp, and turn the crank to adjust the level of the blower. Both of these drawbacks are related to the frame upon which the blower is mounted.

Many different fans and frame stands are disclosed in the prior art, including U.S. Pat. Nos. D181,083, D181,416, D192,622, and D327,947; and U.S. Pat. Nos. 2,954,198, and 4,239,259. Although each of these patents shows a fan and some type of support structure, none of them discloses a stand that is easily but reliably adjustable to tilt the fan upward.

SUMMARY OF THE INVENTION

The present invention solves many of the setup, speed, adjustment and stability problems described above by providing an adjustable support stand for a positive pressure blower having a foot plate attached to a horizontal bar having mounting pins at either end thereof. The horizontal bar is pivotally mounted to a stationary frame using spring or other similar means, so that the ends of the horizontal bar (and the pins thereon) are held against a pair of vertical support members, each support member having an identical set of holes therein for receiving said pins. The vertical support members are part of a larger blower support frame assembly which assembly is pivotally mounted to the stationary frame.

By applying pressure to the foot plate (i.e. by stepping on it) the horizontal bar may be moved away from the vertical support members so that the mounting pins pull out of the holes. This frees the blower support assembly so that its angle of tilt may be adjusted by hand up or down. When the desired angle of tilt is reached, foot pressure to the horizontal bar may be released. When this occurs the locking pins enter corresponding holes in the vertical support members and hold the blower support assembly firmly in place at the new angle. This simple adjustment may be quickly accomplished by the fire fighter without even bending over.

It is therefore a primary object of the present invention to provide a support stand for a positive pressure blower that may be quickly and easily adjusted up or down.

It is a further important object of the present invention to provide an adjustable, tiltable support stand for a positive pressure blower utilizing a foot plate that may be quickly and easily operated by a fire fighter without even bending over.

It is a further object of the present invention to provide an adjustable support stand for a positive pressure blower that is equally stable at any adjusted angle.

It is a further object of the present invention to provide a portable, lightweight support stand for a positive pressure blower that may be quickly and easily adjusted up or down.

It is a further object of the present invention to provide a support stand for a positive pressure blower which results in minimal interference to the efficient air transfer operation of the blower itself.

DETAILED DESCRIPTION OF THE DRAWINGS

No attempt is made to show structural details of the invention in more detail than is necessary for a fundamental understanding of the invention, the description taken with drawings making apparent to those skilled in the art how the several forms of the invention may be embodied in practice.

Figure 1A:
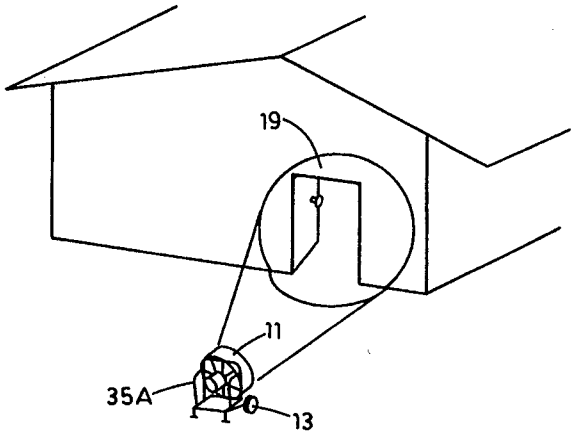
FIG. 1A is an environmental view of the invention showing it holding a positive pressure blower pointed at an upward angle toward an opening of a building.
Figure 1:
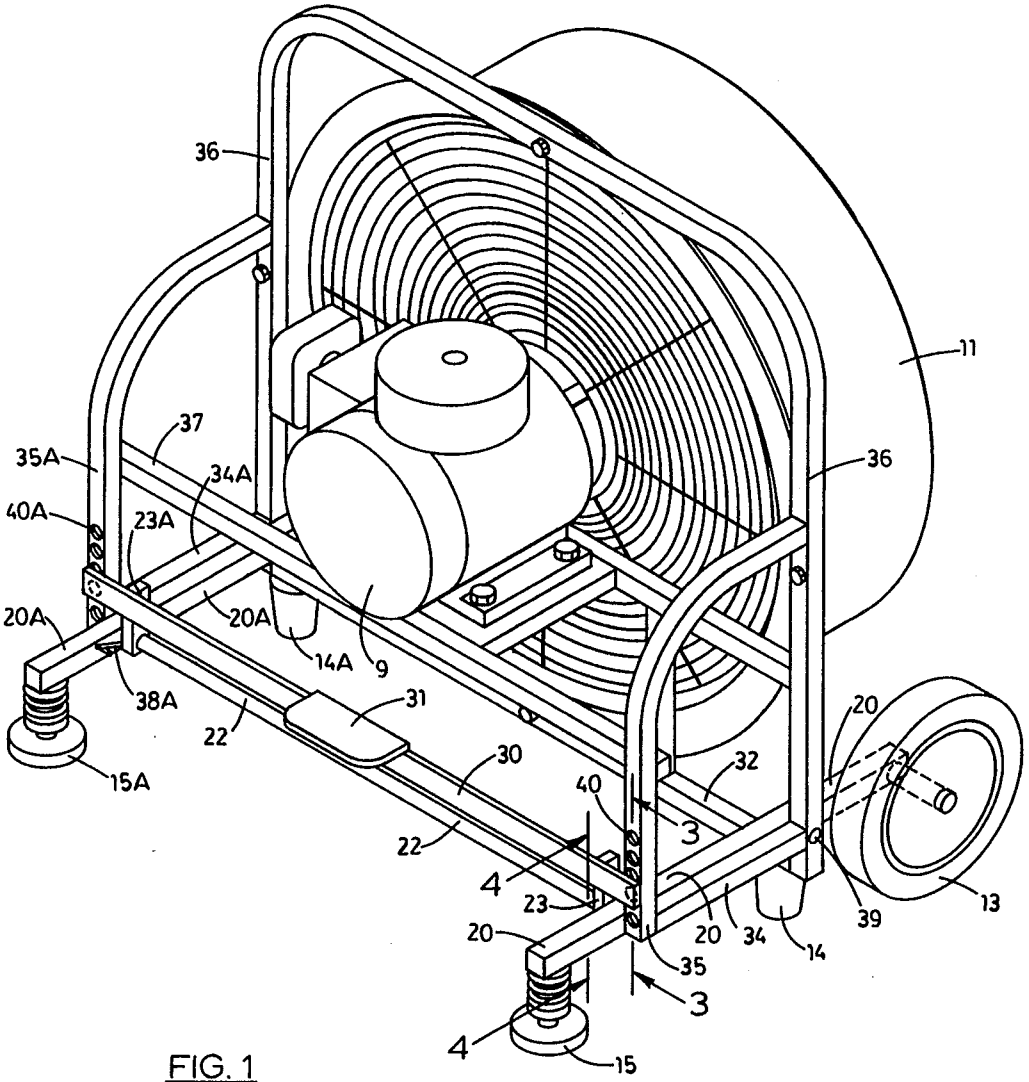
FIG. 1 is a perspective view of the invention.

Referring to the drawings wherein like reference characters designate like or corresponding parts throughout the several views, and referring particularly to FIG. 1, it is seen that the invention includes a stationary frame made up of a pair of parallel members 20 and 20*a* separated by a horizontal cross member 22. At one end of each member 20 and 20*a* wheels 13 and 13*a* are rotatably attached. Below the opposite ends of members 20 and 20*a* flexible support feet 15 and 15*a* are attached. These feet (15 and 15*a*) should be spring loaded or otherwise equipped to withstand changes in the displacement of the load of the blower support assembly. Intermediate said wheels and said flexible support feet, and immediately below pivot 39, a pair of rigid support feet 14 and 14*a* are provided. These parts (20, 20*a*, 22, 13, 13*a*, 14, 14*a*, 15 and 15*a*) make up the stationary frame.

A movable blower support assembly is pivotally mounted on the stationary frame at pivot 39 above support feet 14 and 14*a*. The support assembly includes a wide inverted U-shaped mounting bracket 36, the having two lower legs which are connected at their ends by a cross member 32. The blower support assembly also includes members 34 and 34*a* the first ends of which are attached perpendicularly to the lower ends of bracket 36 above cross member 32. A pair of identical curving bars 35 and 35*a* are perpendicularly attached near the middle of each of the legs of bracket 36. Bars 35 and 35*a* bend downward ninety (90) degrees so that their opposite ends are vertical. The vertical ends of curved bars 35 and 35*a*, respectively, are attached to the opposite ends of members 34 and 34*a*. A cross piece 37 is attached between bars 35 and 35*a* on the back. A plurality of identically spaced openings 40 and 40*a* are provided on the outside faces of the vertical portions of bars 35 and 35*a*. The bottom ends of bracket 36 are pivotally attached to stationary members 20 and 20*a* at pivots 39 and 39*a*, just above cross member 32.

A horizontal latch member 30 is provided in parallel with cross member 22, and is attached at either end to support blocks 23 and 23*a*. Blocks 23 and 23*a* are, in turn, pivotally attached to cross member 22 ,(see FIG. 4). Each of said support blocks 23 and 23*a* are provided with spring means 38 and 38*a* for pulling latch 30 towards the interior of the stationary assembly, and against the vertical parts of brackets 35 and 35*a*. A foot plate 31 is provided at about the middle of latch 30, and pins 33 and 33*a* are provided at the inside edges of either end thereof. A set of corresponding openings 40 and 40*a* are provided in the vertical parts of members 35 and 35*a* for receiving said pins 33 and 33*a*.

Figure 2:
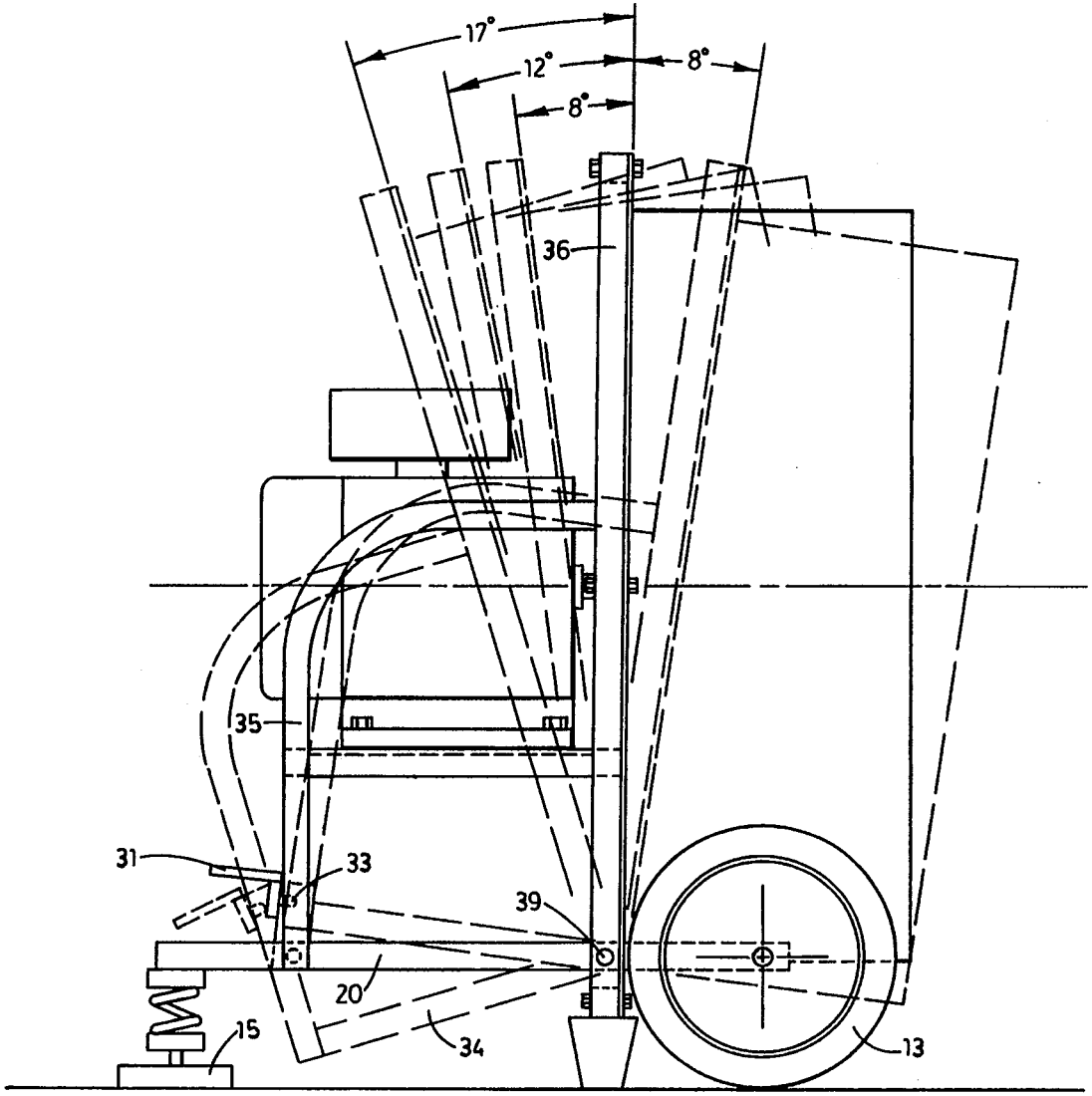
FIG. 2 is a side view of the invention showing different tilted positions thereof in phantom lines.
Figure 4:
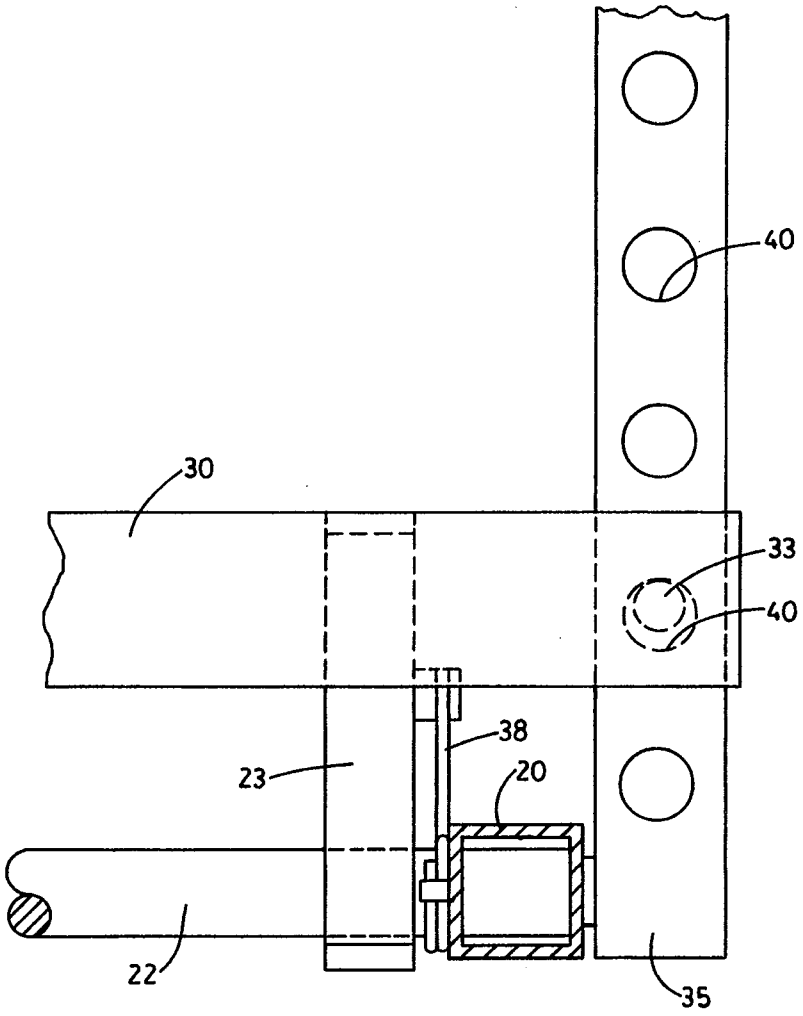
FIG. 4 is a partially cutaway end view of the invention along lines 4—4 of FIG. 1.
Figure 3:
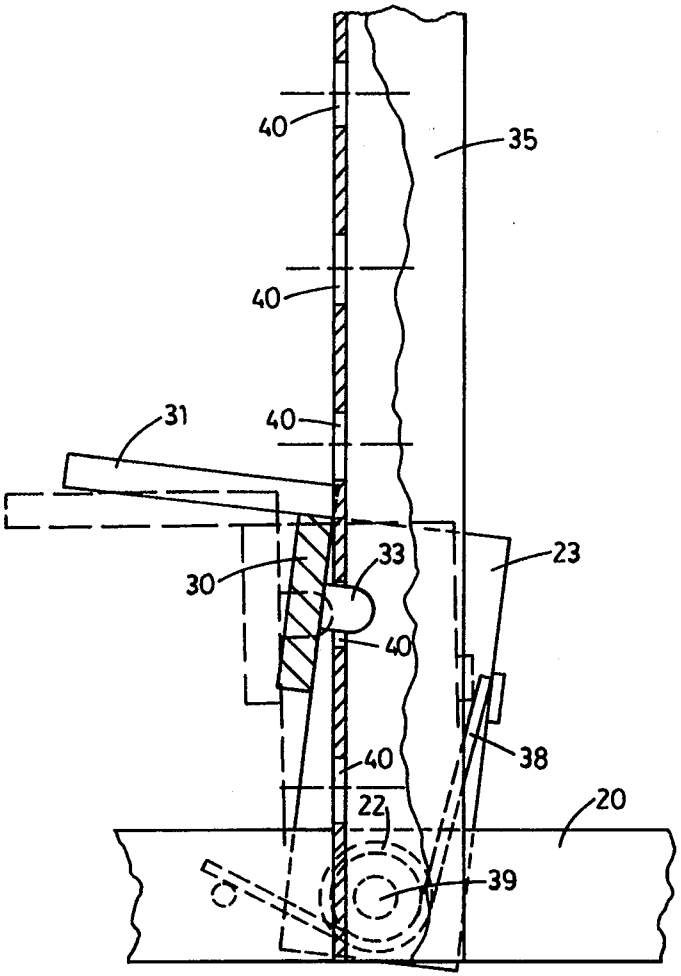
FIG. 3 is a partially cutaway side view of the invention along lines 3—3 of FIG. 1 showing the open position (in phantom lines) and closed position (in solid lines) of the foot latch thereof.

At rest, horizontal bar 30 is held against the vertical parts of members 35 and 35*a* such that pins 33 and 33*a* are inserted into one of each of the holes 40 and 40*a* (see FIG. 4). By applying pressure to plate 31 (e.g. from a human foot), horizontal latch 30 is pulled away from members 35 and 35*a*, and pins 33 and 33*a* are removed from holes 40 and 40*a* (see FIG. 3). This allows the blower support assembly (36, 32, 34, 34*a*, 35, 35*a*, and 37) to be rotated by hand up or down around pivot 39 by grasping and pulling the top of bracket 36 (see FIG. 2). While this adjustment is taking place, the stationary frame (20, 20*a*, 22, 14, 14*a*, 15 and 15*a*) does not move. Once the desired position of the blower assembly is reached, the foot pressure on plate 31 may be released so that bar 30 is pulled back against the vertical parts of members 35 and 35*a*. This results in pins 33 and 33*a* being inserted into different holes 40 and 40*a*, such insertion holding the blower support assembly firmly in place in its new position.

The blower support assembly may be tilted forward (downward) as much as ten (10) degrees by causing pins 33 and 33*a* to be inserted into the lowermost of openings 40 and 40*a*. The blower support assembly may be tilted backward (upward) as much as twenty (20) degrees by causing pins 33 and 33*a* to be inserted into the uppermost of openings 40 and 40*a*. Intermediate angles of tilt may be established depending on the positions of holes 40 and 40*a*.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An adjustable support stand for a blower comprising:

a. a horizontal stationary frame in the form of a modified "H" having two side members bisected by a perpendicular cross member;

b. a movable blower support frame pivotally mounted upon the two side members of said stationary frame;

c. a foot operable latch pivotally mounted upon said stationary frame;

d. a means for engaging said latch into said blower support frame; and e. a means for holding said latch firmly against said blower support frame, wherein as pressure is applied to said latch it moves away from said blower support frame allowing the position of said frame to be pivotally adjusted up or down, so that when pressure is released from said latch it holds said blower support frame in its adjusted position.

2. The stand described in claim 1 wherein the latch engaging means comprises a set of spaced openings provided in the blower support frame, and no less than one corresponding pin provided in said latch so that when pressure is applied to said latch, said pin disengages said openings, and when pressure is released from the latch, said pin engages at least one of said openings.

3. The stand described in claim 2 wherein the latch holding means comprises a spring.

4. The stand described in claim 3 wherein said blower support frame may be rotated around its pivot mount no more than ten (10) degrees forward and no more than twenty (20) degrees backward.

5. The stand described in claim 3 wherein said stationary frame is provided with a pair of rotatable wheels at one end, a pair of adjustable feet at the other end, and a pair of support feet intermediate said wheels and adjustable feet directly below the pivotal mount of said blower support frame.

6. The invention described in claim 3 wherein a foot plate is provided on said latch intermediate its ends.

7. The stand described in claim 1 wherein the latch engaging means comprises two set of spaced openings provided in the blower support frame, and no less than two corresponding pins provided in said latch so that when pressure is applied to said latch, said pins disengage said openings, and when pressure is released from the latch, said pins engage at least two of said openings.

8. An adjustable support stand for a positive pressure blower comprising:

a. a horizontal stationary frame in the shape of a flat modified "H" having two side members bisected by a perpendicular cross member;

b. a movable support frame for holding a positive pressure blower mounted at two parallel pivots upon the two side members of said stationary frame, said support frame including a large bracket to which a positive pressure blower may be attached, and no less than one member immediately adjacent to said stationary frame, said member having a plurality of openings therein;

c. a latch member pivotally mounted upon said stationary frame in parallel with said cross member said latch member having a foot plate :intermediate its ends whereby said latch member is held against said support frame by spring means when at rest; and d. no less than one pin provided in said latch member, said pin spaced to correspond with the plurality of openings in said blower support frame so that when pressure is applied to said latch, said pin disengages said opening allowing the position of said support frame to be pivotally adjusted up or down, so that when pressure is released from the latch, said pin engages at least one of said openings holding said blower support frame in its adjusted position.

9. The stand described in claim 8 wherein said movable support frame may be rotated around its pivot mount no more than ten (10) degrees forward (down) and no more than twenty (20) degrees backward (up).

10. The stand described in claim 8 wherein said stationary frame is provided with a pair of rotatable wheels at the top ends of said side members, a pair of adjustable feet at the opposite ends, and a pair of support feet intermediate said wheels and adjustable feet directly below the pivotal mount of said movable blower support frame.

11. The combination of a positive pressure blower, motor and adjustable support stand comprising:

a. a horizontal stationary frame in the form of a modified "H" having two side members bisected by a perpendicular cross member;

b. a movable blower support frame pivotally mounted upon the two side members of said stationary frame;

c. a foot operable latch pivotally mounted upon said stationary frame;

d. a means for engaging said latch into said blower support frame; and e. a means for holding said latch firmly against said blower support frame, wherein as pressure is applied to said latch it moves away from said blower support frame allowing the position of said frame to be pivotally adjusted up or down, so that when pressure is released from said latch it holds said blower support frame in its adjusted position.

12. The stand described in claim 11 wherein the latch engaging means comprises a set of spaced openings provided in the blower support frame, and no less than one corresponding pin provided in said latch so that when pressure is applied to said latch, said pin disengages said openings, and when pressure is released from the latch, said pin engages at least one of said openings.

13. The stand described in claim 12 wherein the latch holding means comprises a spring.

14. The stand described in claim 13 wherein said blower support frame may be rotated around its pivot mount no more than ten (10) degrees forward and no more than twenty (20) degrees; backward.

15. The stand described in claim 13 wherein said stationary frame is provided with a pair of rotatable wheels at one end, a pair of adjustable feet at the other end, and a pair of support feet intermediate said wheels and adjustable feet directly below the pivotal mount of said blower support frame.

16. The invention described in claim 13 wherein a foot plate is provided on said latch intermediate its ends.

17. The stand described in claim 11 wherein the latch engaging means comprises two set of spaced openings provided in the blower support frame, and no less than two corresponding pins provided in said latch so that when pressure is applied to said latch, said pins disengage said openings, and when pressure is released from the latch, said pins engage at least two of said openings.

* * * * *